US006104127A

United States Patent [19]

Kameyama et al.

[11] Patent Number: 6,104,127

[45] Date of Patent: Aug. 15, 2000

[54] PIEZOELECTRIC TYPE ACTUATOR HAVING STABLE RESONANCE FREQUENCY

[75] Inventors: Tsutomu Kameyama; Kiyoshi Katou; Hiroshi Ichise, all of Saitama-ken, Japan

[73] Assignee: Honda Giken Kogyo Kabushiki Kaisha, Tokyo, Japan

[21] Appl. No.: 09/046,670

[22] Filed: Mar. 24, 1998

[30] Foreign Application Priority Data

May 14, 1997 [JP] Japan ..... 9-139365

[51] Int. Cl.[7] ..... H01L 41/04

[52] U.S. Cl. ..... 310/346; 310/324; 310/328; 310/330

[58] Field of Search ..... 310/324, 344, 310/346, 348, 354–356, 328, 330–332

[56] References Cited

U.S. PATENT DOCUMENTS

| | | | |
|---|---|---|---|
| 3,700,938 | 10/1972 | Bryant | 310/324 X |
| 3,731,124 | 5/1973 | Bryant | 310/324 X |
| 3,746,898 | 7/1973 | Austin et al. | 310/324 X |
| 4,420,706 | 12/1983 | Siebold et al. | 310/324 |
| 4,947,075 | 8/1990 | Maury et al. | 310/324 |
| 4,965,483 | 10/1990 | Abe et al. | 310/324 |
| 5,376,860 | 12/1994 | Sato | 310/346 |
| 5,886,456 | 3/1999 | Stubbs et al. | 310/346 X |

FOREIGN PATENT DOCUMENTS

| | | | |
|---|---|---|---|
| 853355 | 7/1949 | Germany | 310/324 |
| 5-296150 | 11/1993 | Japan . | |

OTHER PUBLICATIONS

Sounder Unit, by Baumhauer et al, Western Electric Technical Digest No. 59 (Jul. 1980) p. 1.

*Primary Examiner*—Mark O. Budd
*Attorney, Agent, or Firm*—Arent Fox Kintner Plotkin & Kahn

[57] ABSTRACT

A piezoelectric type actuator is composed of a vibration element, in which a piezoelectric element is attached on a vibration plate, an upper member and a lower member provided to hold the piezoelectric element. The vibration plate, the upper member, the lower member are made of the material having substantially a same thermal expansion coefficient. Also, a pressure applying mechanism is provided to apply a holding pressure to the lower member such that the vibration element is held with the holding pressure by the lower member and the upper member.

6 Claims, 10 Drawing Sheets

PIEZOELECTRIC TYPE ACTUATOR HAVING STABLE RESONANCE FREQUENCY

BACKGROUND OF THE INVENTION

1. Field of the Invention

The present invention relates a piezoelectric type actuator, and more particularly to a piezoelectric type actuator having a stable resonance frequency.

2. Description of the Related Art

A conventional diaphragm type micropump which uses a piezoelectric type actuator is disclosed in Japanese Laid Open Patent Application (JP-A-Heisei 5-296150). In the conventional example of the piezoelectric type actuator, a ceramic plate on which a piezoelectric vibration element is installed is used as a diaphragm. The diaphragm is installed on the wall section of a housing of a piezoelectric type actuator such that the diaphragm can vibrate in forward and back directions. An inlet port and outlet port are provided for a room in the front of the diaphragm and the room of the back of the diaphragm acts as a pump room. The diaphragm vibrates in the forward and back directions in response to drive vibration from a driving circuit so that a pump operation is carried out.

However, in this conventional example, a problem of an area ratio between the inlet port and the outlet port and another problem of the position of the inlet port are only considered. The easiness of assembly of the piezoelectric type actuator and the relation of the piezoelectric type actuator and a driving circuit for driving it are not considered at all.

FIG. 1 shows a cross sectional view of a piezoelectric type pump after assembly to which another conventional piezoelectric type actuator using a piezoelectric vibration element is applied. Referring to FIG. 1, the piezoelectric type pump is composed of an upper member 102, a piezoelectric vibration element 104 and a lower member 106. The piezoelectric vibration element 104 is held between the upper member 102 and the lower member 106 in a given pressure. FIG. 2 is a partially exploded cross sectional view of a holding section in which the piezoelectric vibration element 104 is held between the upper member 102 and the lower member 106. FIG. 3 is a cross sectional view of the dissolved piezoelectric type pump which is shown in FIG. 1.

Referring to FIGS. 1 to 3, the upper member 102 has an upper plate section 140 and a circular cylindrical side wall section 142 which extends downward from the edge portion of the upper plate section 140. An outlet port 112 is formed in the upper plate section 140. In the side wall section 142, an inlet port 114 and a hole 115 for introducing a lead wire to the piezoelectric vibration element 104 are formed. The outer side portion 116 of the side wall section 142 of the upper member 12 extends downward longer than the inner side portion 118 thereof. Thus, a step is formed between the outer side portion 116 and the inner side portion 118 in the side wall section 142. In the surface of the inner side portion 118, a projection portion 118*a* is formed. In the outer side portion 116, holes 151-1 and 151-2 are formed for fastening.

In the piezoelectric vibration element 104, a piezoelectric element 124 composed of PZT ($PbTiO_3$, $PbZrO_3$) is installed on a vibration plate 122. The piezoelectric element 124 is attached on the vibration plate 122 with adhesive material. A lead wire 128 is connected to the piezoelectric element 124 by solder 126. The lead wire 128 covered by insulator is connected to a driving circuit (not illustrated) through the hole 115 which is provided in the side wall section 142 of the upper member 102. The ground line of the driving circuit is connected to the lower member 106.

A drive signal which has a predetermined frequency is supplied from the driving circuit to the piezoelectric element 124 via the lead wire 128. When the drive signal is applied to the piezoelectric element 124 via the lead wire 128, the piezoelectric element 124 vibrates so that the vibration plate 122 vibrates according to the vibration of the piezoelectric element 124. In this way, a pumping operation is accomplished.

The lower member 106 has a base plate section 144 and a circular cylindrical side wall section 134 which extends upward from the edge portion of the base plate section 144. An outer side portion 132 of the base plate section 144 which is located outside of the side wall section 134 is combined with the outer side portion 116 of the upper member 102. The side wall section 134 is combined with the inner side portion 118 of the upper member 102. In the lower member 106, screw holes 152-1 and 152-2 are formed outside of the side wall section 134 in correspondence to the screw holes 151-1 and 151-2 of the upper member 102.

The point that the efficiency becomes the best when the piezoelectric type pump is driven, i.e., the point that a maximum gas stream is accomplished is in the resonance point of the piezoelectric vibration element 104. Therefore, the driving circuit for the pump can be simplified if the resonance frequency does not change due to pressure, temperature and so on, that is, if the this resonance point does not change due to them.

For this purpose, in the piezoelectric type pump for the gas rate microsensor, the upper member 102 and the lower member 106 are assembled in the following manner, such that the piezoelectric vibration element 104 is held between the upper member 102 and the lower member 106, as described above.

First, the piezoelectric vibration element 104 is positioned on the side wall section 134 of the lower member 106. Next, the upper member 102 and the lower member 106 are engaged with each other such that the outer side portion 116 of the upper member 102 is combined with the outer side portion 132 of the lower member 106, and such that the inner side portion 118 of the upper member 102 is combined with the side wall section 134 of the lower member 106. In this case, the piezoelectric vibration element 104 is held between the project portion 118*a* of the inner side portion 118 of the upper member 102 and the surface of the side wall section 134 of the lower member 106, as shown in FIG. 2. After that, the upper member 102 and the lower member 106 are fastened with screws using the screwing holes 151-1, 151-2, 152-1 and 152-2.

As mentioned above, in the structure of the conventional piezoelectric type pump, the peripheral portion of the vibration plate 104 on which the piezoelectric element 124 is mounted is held between the upper member 102 and the lower member 106 with a holding pressure.

The piezoelectric vibration element 104 is distorted because of the stress, when stress is applied to a part of the piezoelectric vibration element 104. The distortion influences the frequency characteristic of the piezoelectric vibration element 104. That is, the load on the holding portion between the upper member 102 and the lower member 106 changes a resonance frequency of the piezoelectric vibration element 104.

As described above, in order to simplify a driving circuit, it is desirable that the resonance frequency does not change because of the conditions such as sealing pressure, temperature and so on. However, there is a problem in that the frequency characteristic of the piezoelectric vibration element changes because of the fastening torque of the screws. Also, it is made apparent that the temperature characteristic of the resonance frequency depended on this screw fastening torque. This is because the frequency characteristic is affected by the magnitude of stress which is generated in the holding portion of the piezoelectric vibration element.

For these reasons, the above-mentioned conventional piezoelectric type pump is assembled in the following manner. That is, each of 4 screws is fastened while the torque is managed in the state in which the upper member 102 and the lower member 106 are pushed to each other with a holding pressure for holding the piezoelectric vibration element 104 incorporated between them. As a result, a desired frequency characteristic can be obtained. In this assembling method, however, there is a problem in that it takes a long time for assembling one pump. In this way, the productivity is low since the precise management of screw fastening torque must be carried out to accomplish the desired frequency characteristic in the piezoelectric type pump having the conventional structure.

FIG. 4 shows an example when a piezoelectric type micropump is applied to a circulation type closed flowing path gas rate sensor in which the slant state of a gas stream generated when an angular speed acts on the sensor is electrically detected.

The gas is spouted out from an outlet port 207 of a diaphragm type piezoelectric micropump (204, 203, 209) by driving the micropump and flows through a flow path 211 which is formed in a casing 210 of the sensor. Then, the gas is spouted out for the inside of the sensor from a nozzle hole 212. The gas which is spouted out for the inside of the sensor causes a gas stream which moves for a pair of heat wires 241 and 242 which are provided in the flow path. When a movement of an angular speed is applied to the sensor, the gas stream flowing through the inner gas flow path is deflected. A sensor signal is outputted to correspond to the difference between the thermal outputs which are generated in the heat wires 241 and 242 by the deflected gas stream. In the above circulation type closed flowing route gas rate sensor, the gas flow route is composed of the outlet port 207, the flowing route 211, the nozzle hole 212, and the inner gas lowing route 213. The load conductance in the nozzle hole 212 where the maximum resistance is provided in the whole of gas flowing route is as large as 106 to 107 ($cm^3/S$). In this case, a sufficient flow rate is accomplished by a limited pump ability of this micropump.

When a piezoelectric type micropump is applied to the circulation type closed flowing route gas rate sensor which is sealed with a predetermined pressure, the resonance frequency of the piezoelectric vibration element 203 changes because of the sealing gas pressure and the peripheral temperature, even if the holding pressure of the holding portion between the upper member 204 and the lower member 209 is supposed to be controlled for simplifying a driving circuit.

FIG. 5 is a measurement result indicating dependency of the resonance frequency upon the sealing pressure. As seen from FIG. 5, the resonance frequency of the piezoelectric vibration element is affected by the peripheral temperature, the holding pressure and the sealing pressure. That is, the resonance frequency of the piezoelectric type actuator changes when the sealing pressure changes even if the piezoelectric type actuator has the resonance frequency characteristic in which the resonance frequency does not almost change because of the temperature change under the atmosphere pressure. For this reason, it is necessary to correct the frequency of the drive vibration which is supplied from the driving circuit to the piezoelectric vibration element. Therefore, there is a problem in that the circuit scale of the driving circuit becomes large.

SUMMARY OF THE INVENTION

The present invention is accomplished in view of the above problems. In accordance with, an object of the present invention is to provide a piezoelectric type actuator which has the structure easy to assemble.

Another object of the present invention is to provide a piezoelectric type actuator which the frequency characteristic is stable to temperature change so that a driving circuit can be simplified.

In order to achieve an aspect of the present invention, a piezoelectric type actuator includes a vibration element in which a piezoelectric element is installed on a vibration plate, and an upper member and a lower member which are used to hold the vibration element. The vibration plate, the upper member, and the lower member are made of a material having substantially a same thermal expansion coefficient. Especially, it is desirable that the vibration plate, the upper member, and the lower member are made of Fe which contains Ni of 42%.

In order to achieve another aspect of the present invention, a piezoelectric type actuator includes a vibration element in which a piezoelectric element is installed on a vibration plate, a housing section composed of an upper member and a lower member which are used to hold the vibration element, a pressure applying mechanism for applying a pressure to the housing section such that the vibration element is held with the pressure by the housing. It is desirable that at least two of the vibration plate, the upper member, and the lower member are made of a material having substantially a same thermal expansion coefficient. It is desirable that the vibration plate, the upper member, and the lower member are made of Fe which contains Ni of 42%.

In this case, when the pressure applying mechanism may include a plate member and an elastic member, the plate member and the upper member form an inner cavity such that the lower member is accommodated in the inner cavity. The lower member is pressed up with the pressure by the elasticity member.

The pressure applying mechanism may include the elastic member and the vibration element is held by the upper member and the lower member with the pressure by as elastic force of the elastic member.

Also, the upper member may include an upper plate section and a first side wall section extending downward from a peripheral portion of the upper plate section to form an inner concave portion by the upper plate section and the first side wall section, the first side wall section including an outer side portion and an inner side portion which is recessed from the outer side portion. In this case, the lower member may include a lower plate section and a second side wall section extending upward from a peripheral portion of the lower plate section to form an inner concave portion by the lower plate section and the second side wall section. Also, the second side wall section engages with the inner side portion such that the vibration plate is held by the second side wall section and the inner side portion.

In order to achieve still another aspect of the present invention, a piezoelectric type actuator includes a vibration element in which a piezoelectric element is installed on a vibration plate, and an upper member and a lower member which are used to hold the vibration element. Here, a position of the lower member is changed such that a holding pressure of the vibration element is substantially maintained, when a length of the upper member and a length of the lower member are changed with a peripheral temperature.

In order to achieve yet still another aspect of the present invention, a piezoelectric type actuator includes an upper member, a lower member on which a vibration element is installed, the vibration element being held by the upper member and the lower member, and a pressure applying mechanism for pressing up the lower member to the upper member with a predetermined pressure. In this case, when the pressure applying mechanism include a plate member and an elastic member, the plate member and the upper member desirably form an inner cavity such that the lower member is accommodated in the inner cavity. Also, the lower member may be pressed up with the predetermined pressure by the elasticity member.

In addition, in order to an aspect of the present invention, a piezoelectric actuator includes a vibration element, a housing section for holding the vibration element, and a holding pressure applying section for providing a holding pressure such that the vibration element is held by the housing section with the holding pressure.

DESCRIPTION OF THE PREFERRED EMBODIMENTS

Next, a piezoelectric type actuator of the present invention will be described below in detail with reference to the attached drawings. For example, the piezoelectric type actuator of the present invention can be applied to a piezoelectric type pump for a micro gas rate sensor. However, the piezoelectric type actuator of the present invention may be possible to apply to various apparatuses.

Figure 1:
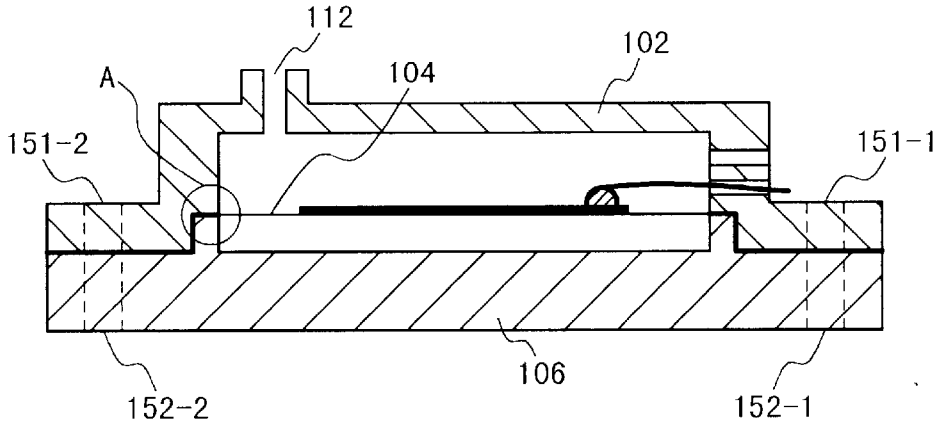
Fig. 1 PRIOR ART
FIG. 1 is a cross sectional view illustrating the structure a conventional piezoelectric type actuator after assembly.
Figure 2:
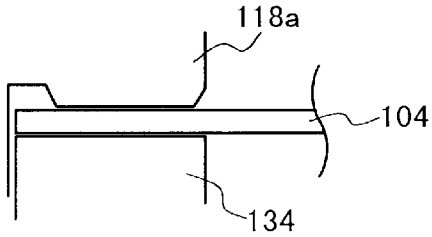
Fig. 2 PRIOR ART
FIG. 2 is a partially exploded cross sectional view illustrating an engaging section between an upper member and a lower member in the conventional piezoelectric type actuator shown in FIG. 1.
Figure 3:
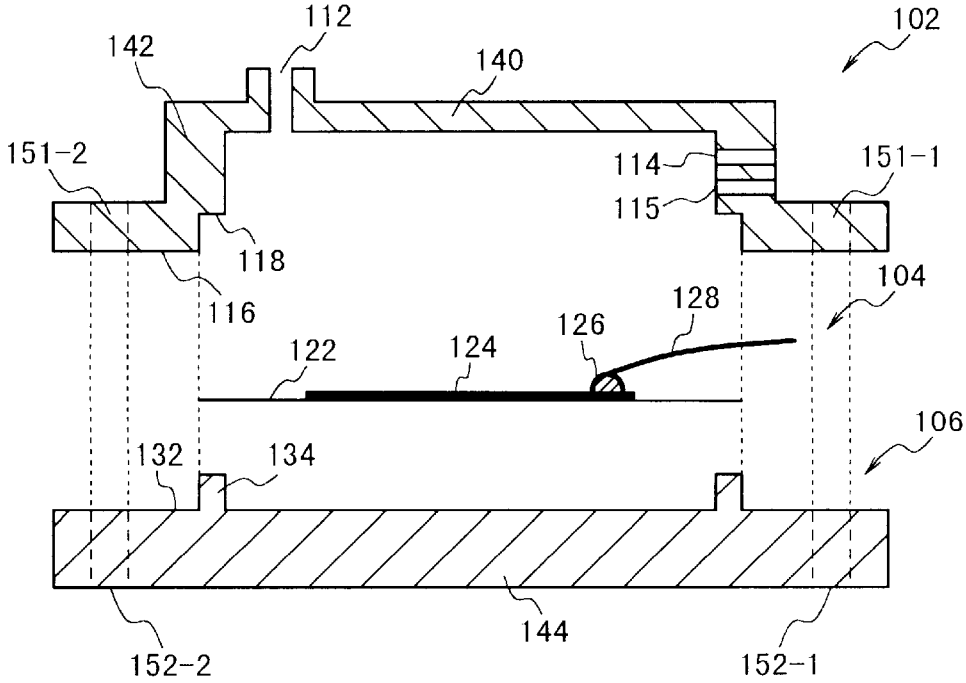
Fig. 3 PRIOR ART
FIG. 3 is an exploded cross sectional view of the conventional piezoelectric type actuator shown in FIG. 1.
Figure 4:
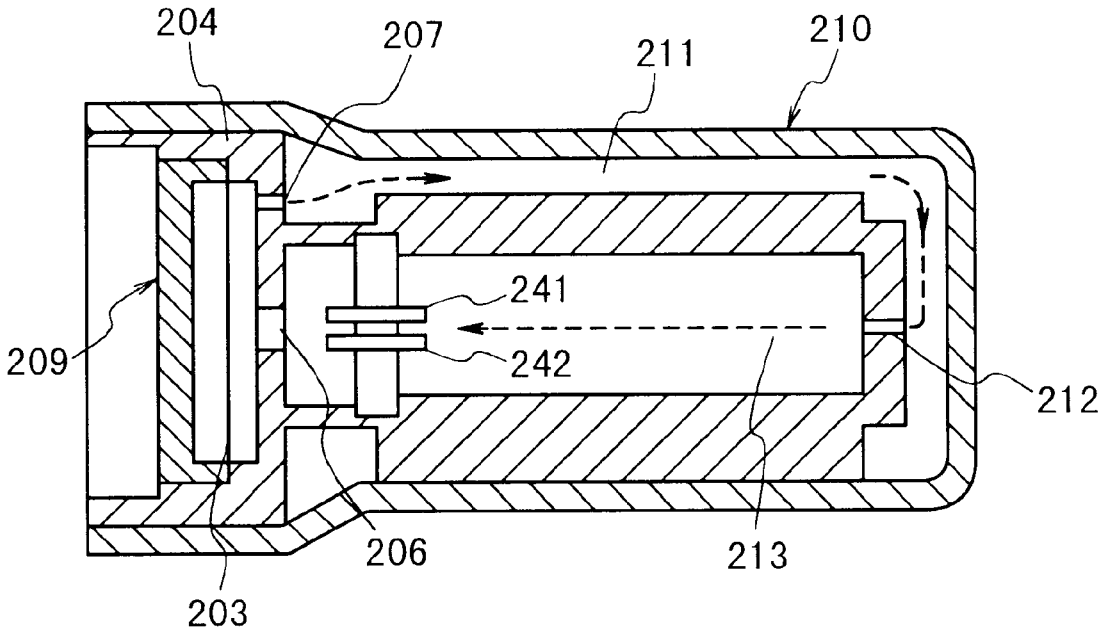
Fig. 4 PRIOR ART
FIG. 4 is a cross sectional view illustrating the structure of a circulation type closed flowing route gas rate sensor to which another conventional piezoelectric type actuator is applied.
Figure 5:
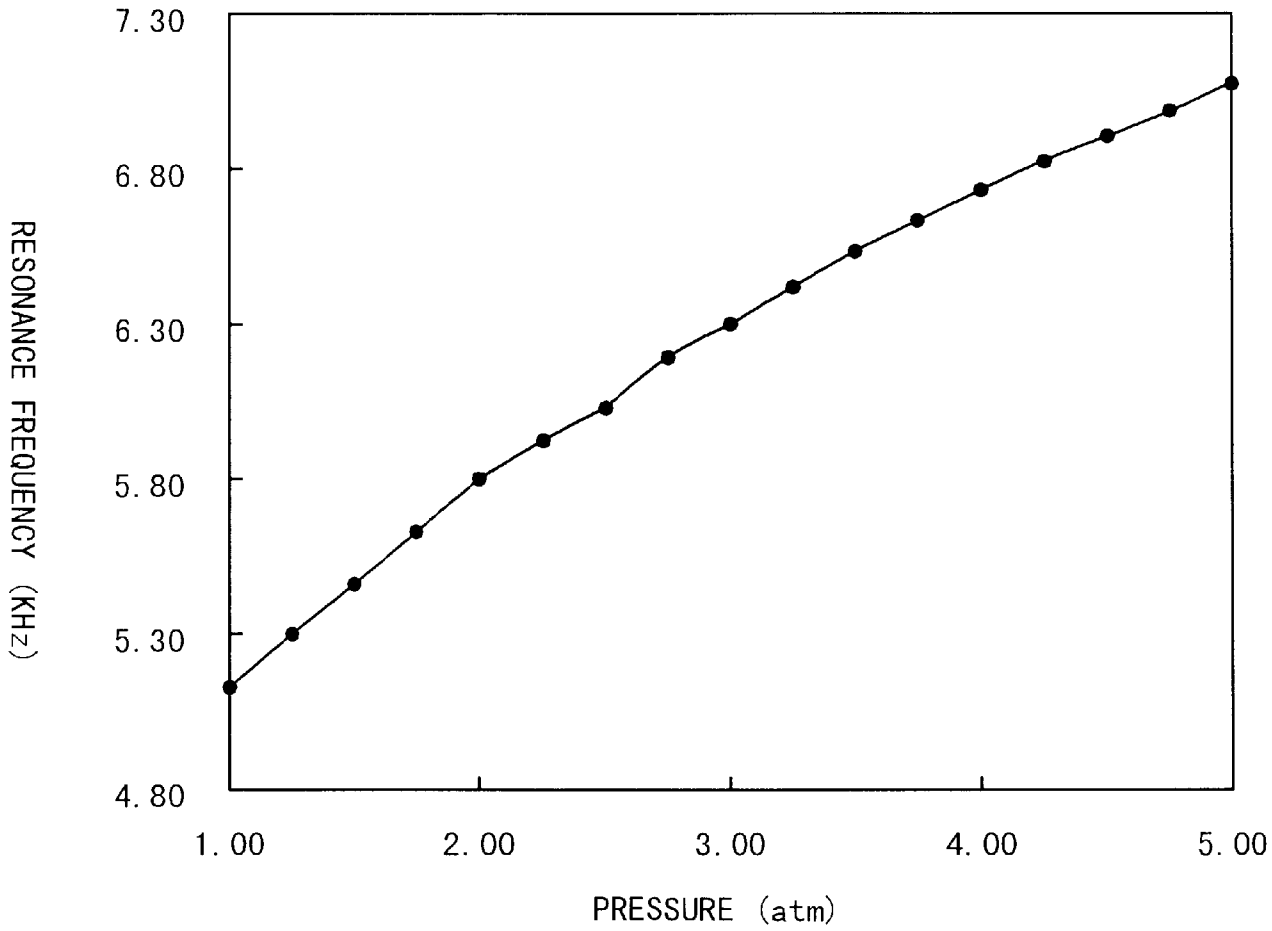
Fig. 5 PRIOR ART
FIG. 5 is a graph illustrating the relation of sealing pressure and resonance frequency in a piezoelectric vibration element when the conventional piezoelectric type actuator is applied to the circulation type closed flowing route gas rate sensor.
Figure 6:
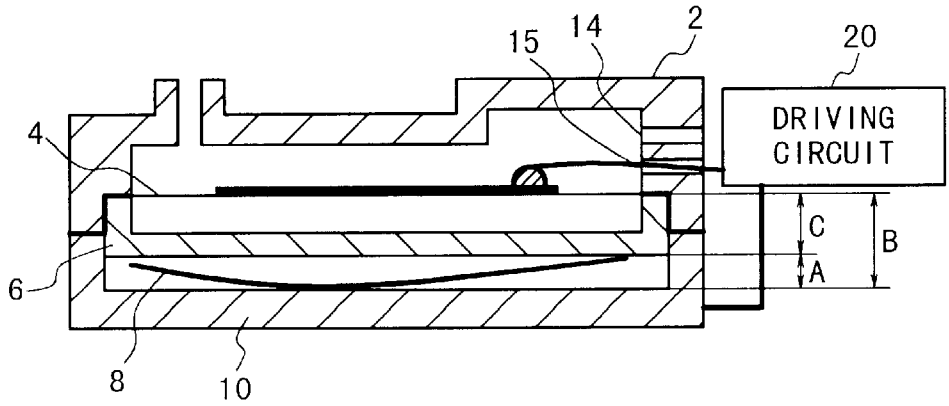
FIG. 6 is a cross sectional view illustrating the structure of a piezoelectric type actuator according to first embodiment of the present invention when it is assembled.

FIG. 6 shows the cross sectional view of the piezoelectric type actuator by the first embodiment of the present invention. Referring to FIG. 6, a piezoelectric type actuator is composed of an upper member 2, a piezoelectric vibration element 4, a lower member 6, a wave washer 8 and a plate member 10.

The upper member 2, the lower member 6, a vibration plate 22 of the piezoelectric vibration element 4 are all formed of 42Ni—Fe series material which contains Ni of 42%. It is desirable that the plate member 10 is also formed of the 42Ni—Fe series material.

Figure 7:
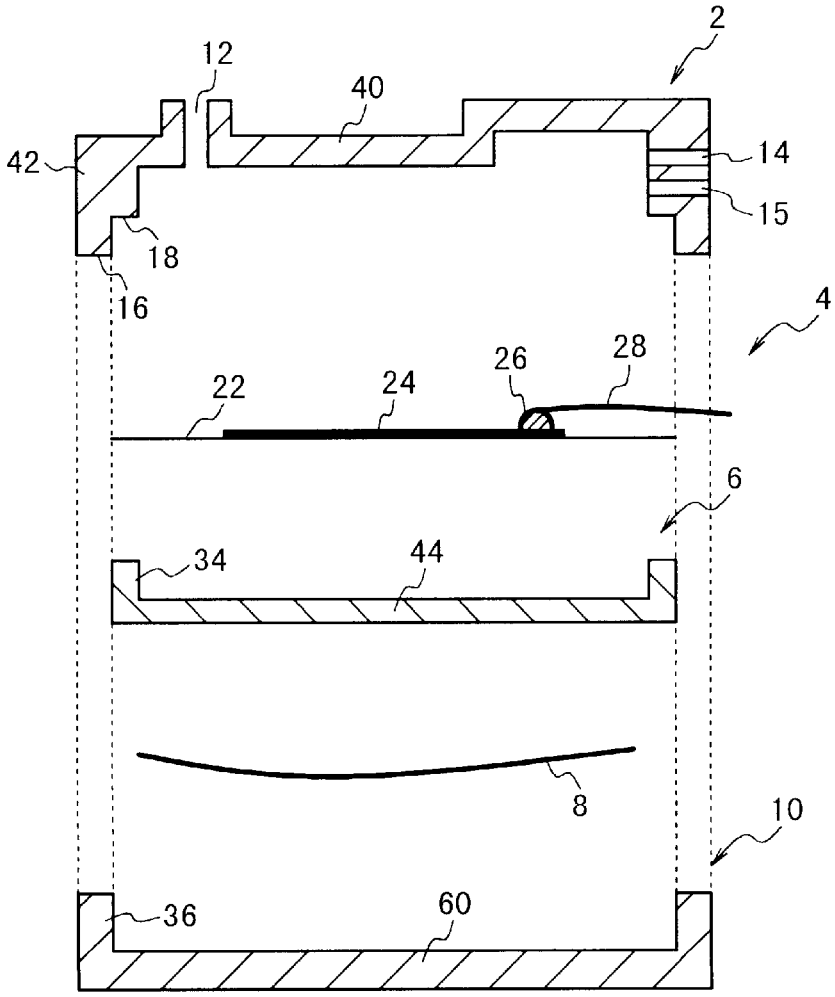
FIG. 7 is an exploded cross sectional view of the piezoelectric type actuator according to the first embodiment of the present invention.
Figure 8:
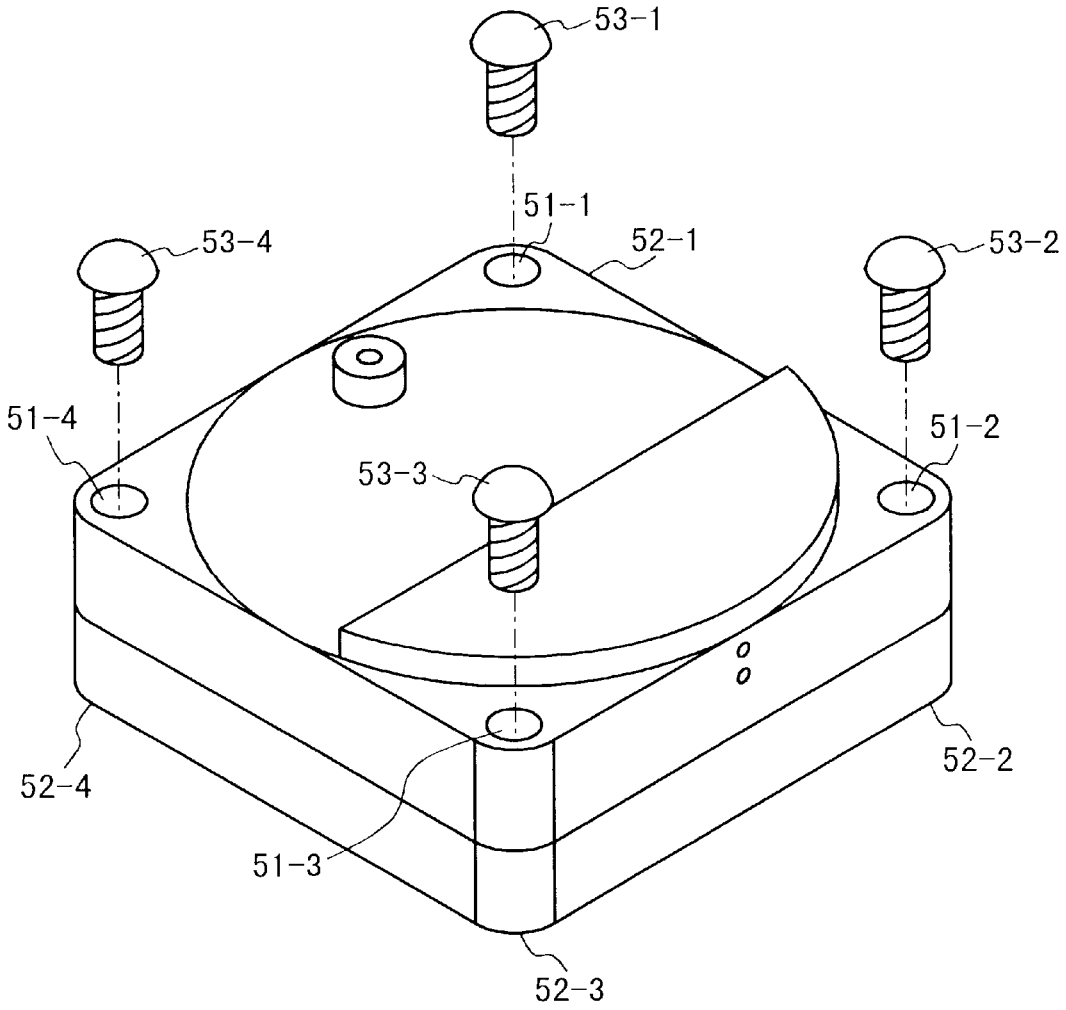
FIG. 8 is a perspective view of the piezoelectric type actuator according to the first embodiment of the present invention after assembly.

FIG. 7 is an exploded cross sectional view of the piezoelectric type actuator shown in FIG. 6. FIG. 8 is a outward perspective view of the piezoelectric type actuator of the present invention.

Referring to FIGS. 6 to 8, the upper member 2 has an upper plate section 40 and a cylindrical side wall section 42 which extends downward from the edge or peripheral portion of the upper plate section 40. In the upper plate section 40, an outlet port 12 is formed. In the side wall section 42, an input port 14 and a hole 15 used to introduce a lead wire to the piezoelectric vibration element 4 are formed.

An outer side portion 16 of the side wall section 42 of the upper member 2 extends downward longer than an inner side portion 18 of the side wall section 42. Thus, a step is formed between the outer side portion 16 and the inner side portion 18 in the side wall section 42. A projection portion (not shown) is formed in the lower surface of the inner side portion 18, as in the conventional example. Holes 51-1 to 51-4 used to fasten with screws are formed in an outer side portion of the upper member 2. The inner diameter of the inner side portion 18 of the side wall section 42 is smaller than the outer diameter of the piezoelectric vibration element 4 to be described below. Also, the inner diameter of the outer side portion 16 is larger than the outer diameter of the piezoelectric vibration element 4.

Figure 9:
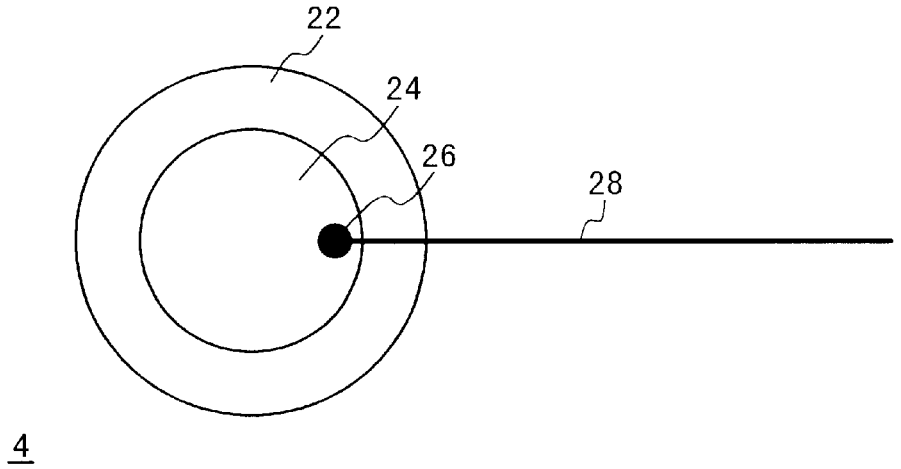
FIG. 9 is a diagram illustrating a piezoelectric vibration element which is used in the piezoelectric type actuator according to the first embodiment of the present invention.

A piezoelectric element 24 composed of PZT ($PbTiO_3$, $PbZrO_3$) is installed on a vibration plate 22 in the piezoelectric vibration element 4, as shown in FIG. 9. The piezoelectric element 24 is adhered on the vibration plate 22 with adhesive material. The lead wire 28 is soldered to the piezoelectric element 24. The lead wire 28 covered is connected to a driving circuit 20 through the hole 15 which is provided in the side wall section 42 of the upper member 2. The ground line of the driving circuit 20 is connected to the conductive palte member 10 and the conductive lower member 6. A drive signal having a predetermined frequency is supplied through the lead wire 28 from the driving circuit 20 to the piezoelectric element 24. When the drive signal is supplied to the piezoelectric element 24 through the lead wire 28, the piezoelectric element 24 vibrates and then the vibration plate 22 vibrates according to the vibration of the piezoelectric element 24. In this way, a pump operation is realized.

Referring to FIGS. 6 and 7 again, the lower member 6 has the lower plate section 44 and the circular cylindrical side wall section 34 which extends upward from the edge portion of the lower plate section 44. The side wall section 34 is combined with the inner side portion 18 of the upper member 2. The outer diameter of the side wall section 34 is formed to be smaller than the inner diameter of the outer side portion 16 of the upper member 2. The inner diameter of the side wall section 34 is substantially the same as the inner diameter of the inner side portion 18 of the upper member 2. Thus, the piezoelectric vibration element 4 can be put on the upper surface of the side wall section 34 of the lower member 6. Also, when the upper member 2 is engaged with the lower member 6, the piezoelectric vibration element 4 can be held between the side wall section 34 and the inner side portion 18.

Figure 10:
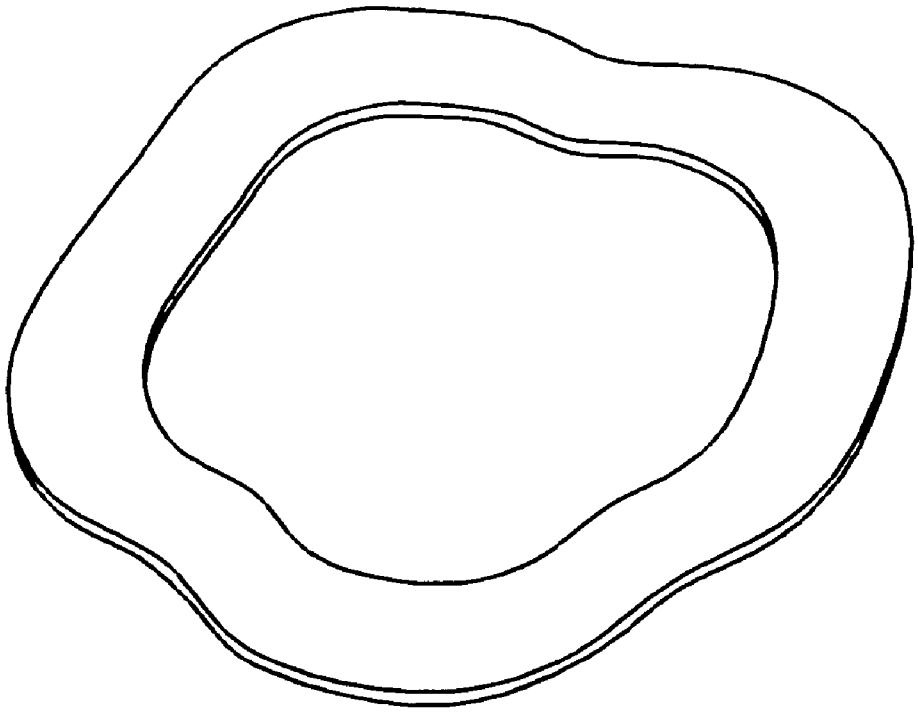
FIG. 10 is a diagram illustrating a wave washer which is used in the piezoelectric type actuator according to the first embodiment of the present invention.

The shape of the wave washer 8 is shown in FIG. 10. As seen from FIG. 10, an elastic material ring plate is transformed to have a wave shape. The height difference between the top height position of the wave washer 8 and the lowest height position is slightly larger than a length A shown in FIG. 6. At this time, no elastic force acts.

The plate member 10 has a base plate section 60 and a side wall section 36 having a circular cylindrical shape which extends upward from the peripheral portion of the base plate section 60. The side wall section 36 of the plate member is combined with the outer side portion 16 of the upper member 2.

Next, an assembling method of the piezoelectric type actuator of the present invention will be described.

First, the lead wire 28 of the piezoelectric vibration element 4 is passed through the hole 15 of the upper member 2 and is connected with the driving circuit 20.

Next, the lower member 6 and the upper member 2 are engaged with each other in such a manner that the inner side portion 18 of the upper member 2 is mated to the side wall section 34 of the lower member 6. At this time, because the outer diameter of the piezoelectric vibration element 2 is slightly smaller than the outer diameter of the side wall section 34 of the lower member 6, there is no possibility that the center of the piezoelectric vibration element 2 is displaced greatly.

Next, the wave washer 8 is put in the concave portion which is formed of the side wall section 36 of the plate member 10. After that, the plate member 10 and the upper member 2 are engaged with each other in such a manner that the outer side portion 16 of the upper member 2 is mated to the side wall section 36 of the plate member 10.

The upper member 2 and the plate member 10 are tightly fastened with screws 53-1 to 53-4 through the holes which are provided around the piezoelectric type actuator.

Here, a length B is from the lowest portion of the inner side portion 18 of the upper member 2 to the upper surface of the base plate section 60 of the plate member 10. The length C is from the lowest portion of the inner side portion 18 of the upper member 2 to the lower surface of the lower plate section 44 of the lower member 6. The length C is the same as the height of the side wall section 34 of the lower member 6 from the lower surface of the lower plate sectin 44, neglecting the thickness of the vibration plate 22. The length A is from the lower surface of the lower plate section 44 of the lower member 6 to the upper surface of the base plate section 60 of the plate member 10. Thus, the length B is equal to (the length C)+(the length A), i.e., B=C+A.

Since the wave washer 8 originally has the height slightly longer than the length A, it is pressed down to the height A to output repulsion force. The lower member 6 is pushed up by the repulsion force, so that the piezoelectric vibration element 4 is held with a predetermined holding pressure between the upper member 2 and the lower member 6. That is, the lower member 6 functions as a movable section whose position is determined in accordance with the repulsion force of the wave washer 8. Also, the wave washer 8 and the plate member 10 act as the pressure applying mechanism.

In this way, in the piezoelectric type actuator of the present invention, the length A from the lower surface of the lower plate section 44 of the lower member 6 to the upper surface of the base plate section 60 of the plate member 10 is managed. Also, the height of the wave washer 8 is managed. As a result, the holding pressure of the piezoelectric vibration element can be determined without strictly controlling the fastening pressure when the upper member 2 and the plate member 10 are combined with screws.

As described above, in the piezoelectric type actuator of the present invention, in order to hold the piezoelectric vibration element 4 with a desired pressure, a part having elasticity, e.g., the wave washer 8 in this example, is used. Consequently, one of the upper member 2 and the lower member 6, e.g., the lower member 6 in this example, is pressed to the other, i.e., the upper member 2 with a predetermined pressure. In this manner, if the height of the portion where the elastic part is inserted is made constant, the pump having a desired frequency characteristic can be simply assembled.

The measurement result when the piezoelectric type actuator according to the first embodiment of the present invention is applied to the piezoelectric type pump will be explained below.

Figure 11:
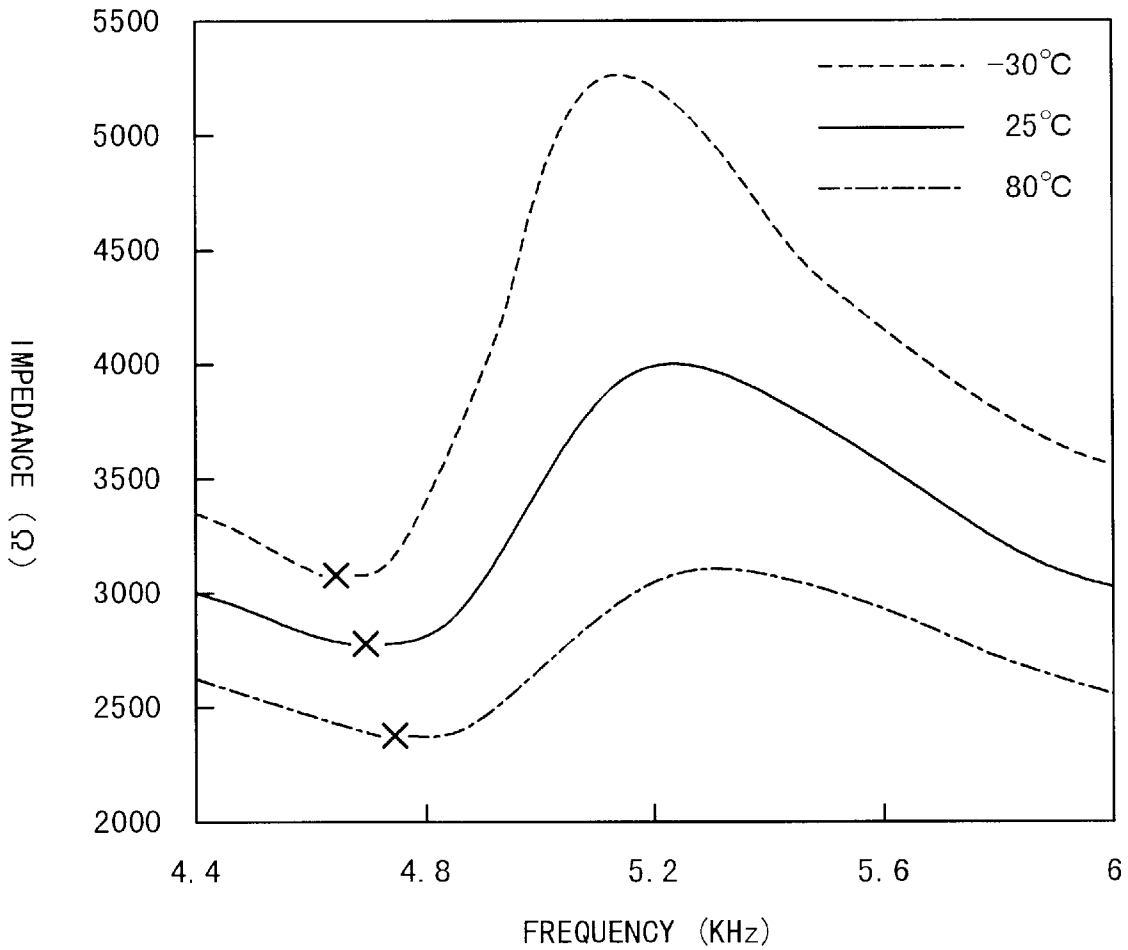
FIG. 11 is a graph illustrating the frequency dependency of impedance of the piezoelectric vibration element which is used in the piezoelectric type actuator according to the first embodiment of the present invention.

FIG. 11 is a graph illustrating the measuring result which indicates the change of the piezoelectric element in impedance measured when the frequency of the drive signal to the piezoelectric vibration element is changed. In FIG. 11, the solid line indicates the characteristic at the room temperature of 25° C. The dotted line indicates the characteristic at the temperature of −30° C. The alternate short and long dash line indicates the characteristic at the temperature of 80° C.

The frequency at a resonance point, i.e., the resonance frequency corresponds to the frequency of the point in which the impedance of the piezoelectric vibration element became the lowest. In the resonance frequency, the piezoelectric vibration element vibrates at the maximum amplitude. That is, to use the piezoelectric vibration element with the resonance frequency is the most efficient in the pump and, therefore, a maximum flow rate is accomplished. As seen from FIG. 11, even if the temperature changes from −30° C. to 80° C., the resonance frequency does not change so much.

Figure 12:
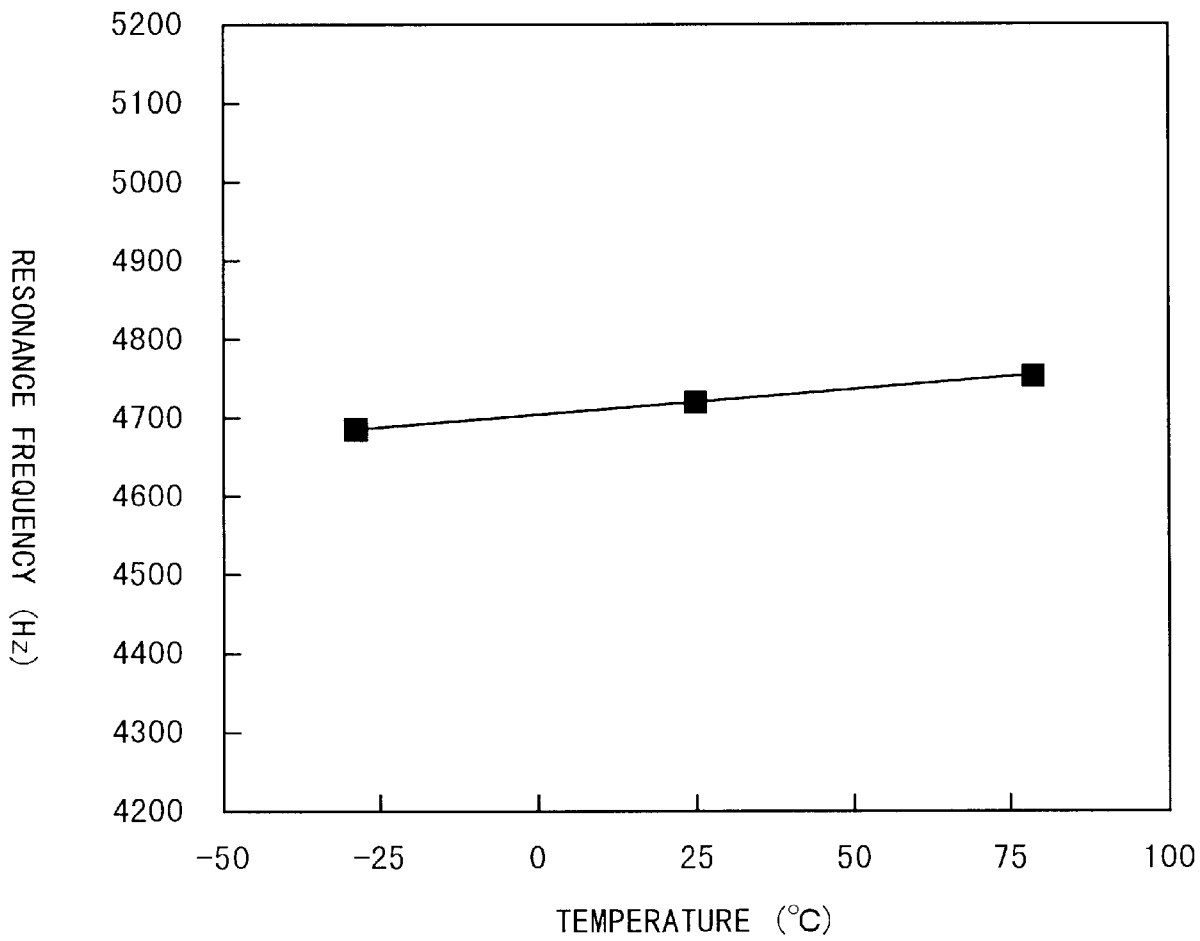
FIG. 12 is a graph illustrating the temperature change of the resonance frequency of the piezoelectric type actuator according to the first embodiment of the present invention when the piezoelectric type actuator is located in the closed type apparatus sealed with 2 atoms.

FIG. 12 is a graph illustrating the temperature dependency of the resonance frequency of the piezoelectric vibration element. As seen from FIG. 12, even if the temperature changes from −30° C. to 80° C., the resonance frequency is about 100 Hz in change width and is stable.

As understood from the above result, when the piezoelectric type actuator of the present invention is used, the operation frequency range of the driving circuit can be made narrow. That is, because it is not necessity to provide a complicated temperature compensating circuit in the driving circuit, the driving circuit can be simplified.

Figure 13:
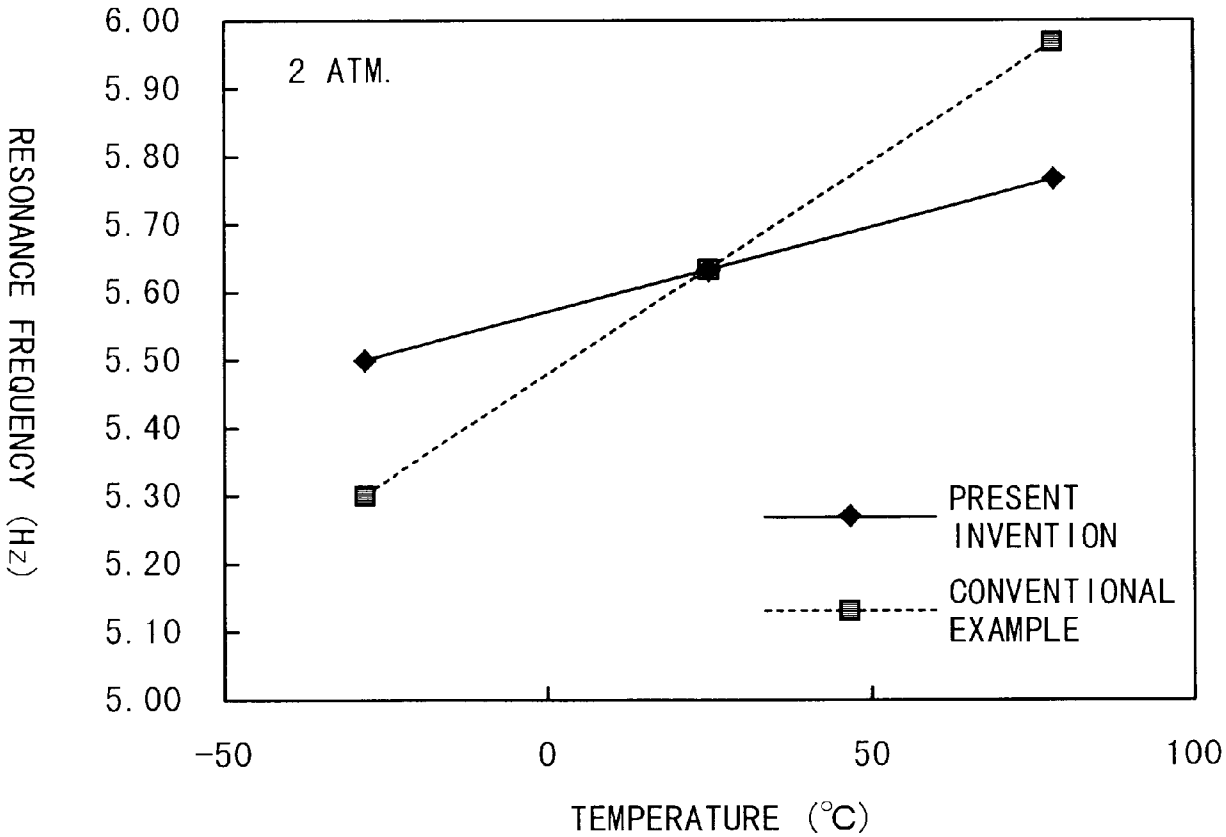
FIG. 13 is a graph illustrating the temperature dependency of the resonance frequency of the piezoelectric vibration element which is used in the piezoelectric type actuator according to the first embodiment of the present invention.

Below, the measurement result of the temperature dependence of the resonance frequency of the piezoelectric type actuator according to the first embodiment of the present invention will be explained. FIG. 13 indicates the measurement result when the piezoelectric type actuator is sealed with the pressure of 2 atoms. The dotted line indicates the measurement result of the conventional example. The solid line indicates the measurement result when the piezoelectric type actuator of the present invention is used.

In the conventional example, when the temperature changes from −30° C. to 80° C., the resonance frequency changes in the frequency range of about 700 Hz. On the other hand, in the piezoelectric type actuator of the present invention, the resonance frequency change is only in the frequency range of about 250 Hz. As seen from this result, in the piezoelectric type actuator of the present invention, because the temperature dependency of the resonance frequency is reduced, the driving circuit 20 can be simplified.

This can be thought of as follows. That is, in the conventional example of the piezoelectric type actuator, the resonance frequency change can be suppressed against the temperature change under the atmosphere pressure. However, when the piezoelectric type actuator is sealed with a given pressure, the resonance frequency changes as follows. Because the sealing pressure rises when the peripheral temperature changes from the room temperature to a high temperature, the resonance frequency becomes high, as seen from FIG. 13. On the other hand, because the sealing pressure decreases when the peripheral temperature changes from the room temperature to a low temperature, the resonance frequency becomes low. The resonance frequency of the single body vibration element 4, i.e., the resonance frequency of the vibration element 4 when it is not held between the upper member 2 and the lower member 6 becomes low, as the peripheral temperature changes from the room temperature to the high temperature. On the other hand, when the peripheral temperature changes from the room temperature to the low temperature, the resonance frequency becomes high. In other words, if the temperature characteristic of the resonance frequency of this single body vibration element 4 is utilized, the change of the resonance frequency can be made small, even if the peripheral temperature changes in the state in which the piezoelectric type actuator is sealed in the closed flowing route system with a given pressure.

In the conventional example, the piezoelectric vibration element 4 is held with a given holding pressure. Also, since the material of the upper member 2, the material of the lower member 6 and the material of the vibration plate 22 of piezoelectric vibration element 4 are different from each other, the difference between materials in thermal expansion is generated when the peripheral temperature changes. As a result of the difference, the holding pressure of the piezoelectric vibration element 4 changes so that the resonance frequency of the piezoelectric vibration element 4 becomes different from that of the piezoelectric element 24 itself. Also, as a result of the difference, the distortion is generated inside the piezoelectric vibration element 4, and the distortion produces a resonance frequency different from that of the piezoelectric element 24 itself.

In the first embodiment of the present invention, the upper member 2 and the lower member 6 are formed of the same material as that of the vibration plate 22 of the piezoelectric vibration element 4. That is, the upper member 2, the lower member 6 and the vibration plate 22 of the piezoelectric vibration element 4 are formed of the material which has the same thermal expansion coefficient. Accordingly, even when the piezoelectric vibration element 4 is held between the upper member 2 and the lower member 6, the characteristic which is near the temperature characteristic of the resonance frequency of the single body piezoelectric vibration element 4, i.e., in the state in which the piezoelectric vibration element 4 is not held can be accomplished. As a result, the change of the resonance frequency of piezoelectric vibration element 4 can be suppressed even if the peripheral temperature change in the state in which the piezoelectric type actuator is sealed with a given pressure.

In the first embodiment of the present invention, the upper member 2, the lower member 6 and the vibration plate of the piezoelectric vibration element 4 are formed of 42Ni—Fe. This produces a good result. However, if all of the components, e.g., the wave washer 8, the plate member 10 and so on are formed of the material which has the same thermal expansion coefficient as the material of the vibration 22 of the piezoelectric vibration element 4, a further good result can be accomplished.

If the temperature change of the length in the horizontal direction in FIG. 6 is considered, the upper member 2 and the lower member 6 change by the same change amount as the change amount in the piezoelectric vibration element 4. In accordance with, even when the peripheral temperature changes, the compression force or the extension force does not act to the piezoelectric vibration element 4 in the horizontal direction. That is, the temperature change of the resonance frequency is possible to be considered in the same manner as there is no temperature change.

Also, the temperature change of the length in the vertical direction is considered in FIG. 6. In this case, the side wall section 42 of the upper member 2 extends downward and the side wall section 36 of the plate member 10 extends upward. Also, the side wall section 34 of the lower member 6 also extends upward. Further, in the wave washer 8, the amplitude of the wave shape is in the vertical direction. Therefore, the repulsion force of the wave washer 8 is stable even if there is a temperature change. In this manner, even if the peripheral temperature changes, the holding pressure of the piezoelectric vibration element 4 is stable. Therefore, the influence to the temperature change of the resonance frequency is also less.

As understood from above result, when the piezoelectric type actuator of the present invention is used, the operation frequency range of the driving circuit can be made narrow. That is, because it is not necessary to provide a complicated temperature compensating circuit in the driving circuit, the driving circuit can be simplified.

Figure 14:
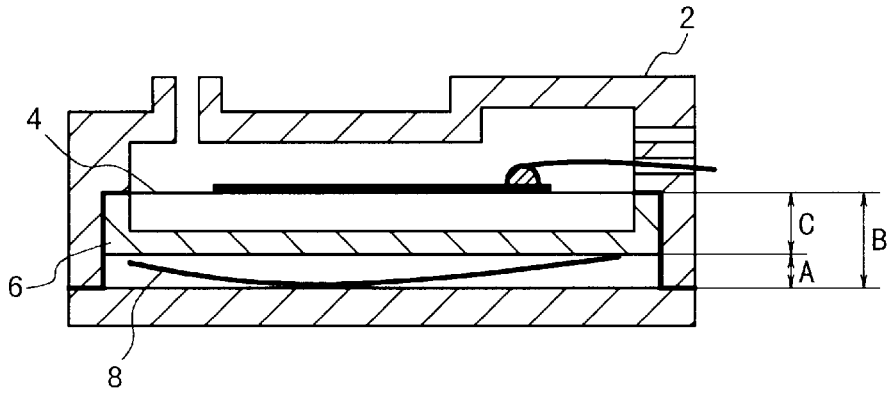
FIG. 14 is a cross sectional view illustrating the structure of the piezoelectric type actuator according to a second embodiment of the present invention after assembly.
Figure 15:
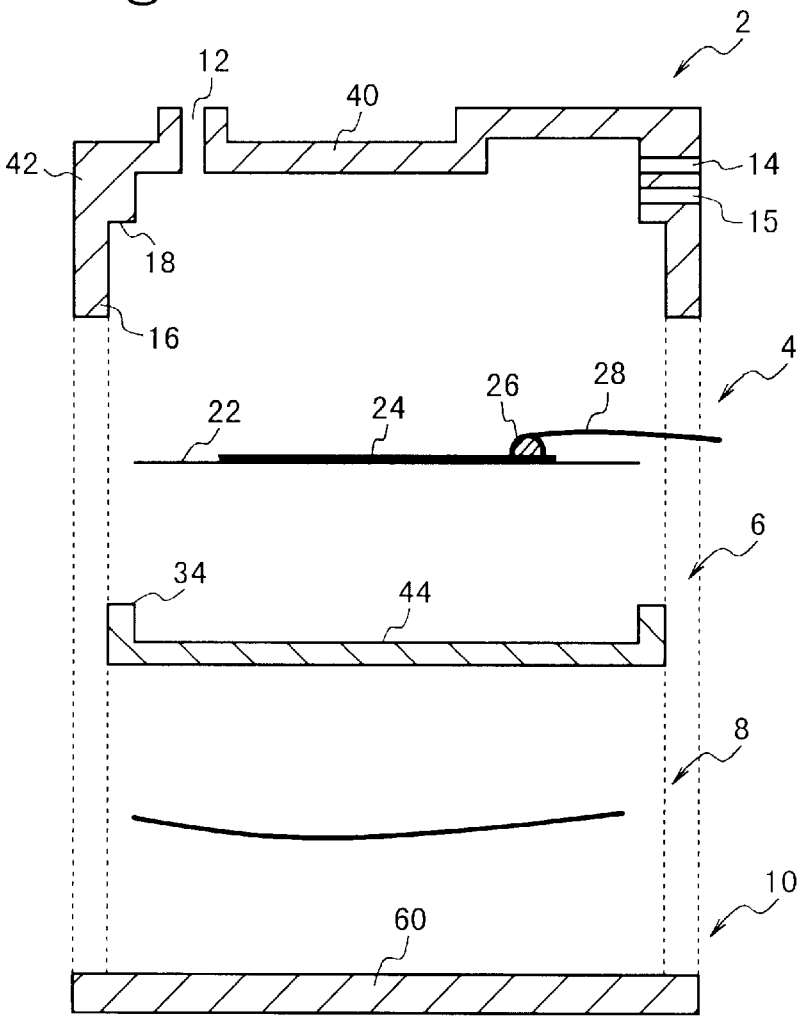
FIG. 15 is an exploded cross sectional view of the piezoelectric type actuator according to the second embodiment of the present invention.

Next, the piezoelectric type actuator according to the second embodiment of the present invention will be described with reference to FIGS. 14 and 15. In this embodiment, the plate member is a flat plate on which the piezoelectric type actuator should be installed. The outer side portion 16 of the side wall section 42 of the upper member 2 extends downward longer than in the first embodiment. That is, the length from the lower surface of the inner side portion 18 of the upper member 2 to the lower surface of the outer side portion 16 is equal to the length B. Thus, even in this case, the distance from the lower surface of the lower plate section 44 of the lower member 6 to the upper surface of the base plate section 60 of the plate member 10 is A, which is the same as in the first embodiment. Therefore, the piezoelectric type vibration element 4 can be held with a given holding pressure only by managing the distance A.

The assembling method is the same as the assembling method in the first embodiment. In accordance with, if the height of the lower member 6 is managed, as in the first embodiment, it is possible to accomplish the stabilization of the resonance frequency of the piezoelectric vibration element without precisely managing screw fastening torque.

As described above, according to the piezoelectric type actuator of the present invention, it is possible to couple the upper member to the plate member without managing the screw fastening torque precisely. That is, the assembling process of the piezoelectric type actuator can be simplified and the productivity can be improved. As the pressure applying structure in this case, the wave washer is used in the above embodiments. However, the pressure applying structure is not limited to it. Other elastic members such as a normal winding spring, a plate spring and so on may be used. It should be noted that it is desirable to hold the piezoelectric type vibration element with a uniform holding pressure not depending on place.

Also, various methods may be used as the method of coupling the upper member and the plate member. In the embodiments of the present invention, they are fastened with screws. However, for example, the methods of coupling the upper member and the plate member such as a staking method, a welding method, an adhering method can be used.

Also, since the resonance frequency of the piezoelectric vibration element can be more stabilized, the structure of the driving circuit for the piezoelectric vibration element can be simplified. In accordance with, the manufacturing cost can be reduced.

As described above, according to the piezoelectric type actuator of the present invention, since the components such as the upper member, the lower member and so on are formed of the material which has the same thermal expansion coefficient as that of the vibration plate of the piezoelectric vibration element. Therefore, even if the piezoelectric type actuator is supposed to have been sealed at a given pressure in the closed flowing route type gas rate sensor, it is possible to eliminate or reduce the temperature dependence of the resonance frequency of the piezoelectric vibration element reduce.

What is claimed is:

1. A piezoelectric type pump comprising:

a vibration element in which a piezoelectric element is installed on a vibration plate;

a housing having an output port and an inlet port; and a holding pressure applying mechanism providing a holding pressure such that said vibration element is held by said housing with said holding pressure, wherein said holding pressure applying mechanism is wave washer.

2. A piezoelectric type actuator comprising:

a vibration element in which a piezoelectric element is installed on a vibration plate;

an upper casing member having an upper section and a first side section, wherein said first side section extends downward from a peripheral portion of said upper section, said first side section has an outer side section and an inner side section, said outer side section is longer than said inner side section;

an inner lower casing member having a first lower section and a peripheral section extending upward from an edge portion of said first lower section, wherein said inner lower casing member is smaller than said outer side section and said inner lower casing member engages with said inner side section such that said vibration element is held by said peripheral section and said inner side section; and a pressure applying mechanism having a lower plate section and an elastic washer, wherein said elastic washer is provided between said inner lower casing member and said lower plate section, and said pressure applying mechanism engages with said outer side section of said first side section to apply a pressure to said inner lower casing member by said elastic washer such that said vibration element is held with the pressure by said peripheral section and said inner side section.

3. A piezoelectric type actuator according to claim 3, wherein at least two of said vibration plate, said upper casing member, said inner lower casing member, and said pressure applying mechanism are made of a material having substantially a same thermal expansion coefficient.

4. A piezoelectric type actuator according to claim 5, wherein said vibration plate, said upper casing member, and said inner lower casing member are made of Fe which contains Ni of 42%.

5. A piezoelectric type actuator according to claim 3, wherein said lower plate section of said pressure applying mechanism includes a second side section extending upward from a peripheral portion of said lower plate section to engage with said outer side section of said first side section such that said inner lower casing member, said elastic member and said vibration element are accommodated in a cavity formed by said pressure applying mechanism and said upper casing member.

6. A piezoelectric type actuator according to claim 2, wherein said elastic washer is a wave washer.

* * * * *